US012050085B2

(12) United States Patent
Zemany

(10) Patent No.: US 12,050,085 B2
(45) Date of Patent: Jul. 30, 2024

(54) BALLISTIC GUIDANCE SYSTEM

(71) Applicant: BAE SYSTEMS Information and Electronic Systems Integration Inc., Nashua, NH (US)

(72) Inventor: Paul D. Zemany, Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 85 days.

(21) Appl. No.: 18/080,052

(22) Filed: Dec. 13, 2022

(65) Prior Publication Data

US 2024/0200903 A1 Jun. 20, 2024

(51) Int. Cl.
*F41G 7/34* (2006.01)
*F42B 10/64* (2006.01)

(52) U.S. Cl.
CPC ..... *F41G 7/34* (2013.01); *F42B 10/64* (2013.01); *F41G 7/346* (2013.01)

(58) Field of Classification Search
CPC ..... F41G 7/34; F41G 7/346; F42B 10/64
See application file for complete search history.

(56) References Cited

U.S. PATENT DOCUMENTS 5,467,940 A * 11/1995 Steuer ..... F42B 10/64 102/385
5,590,850 A * 1/1997 Cannon ..... F42B 10/663 244/3.21
6,883,747 B2 4/2005 Ratkovic et al.
7,105,790 B2 * 9/2006 Lamorlette ..... F41G 7/346 701/472
7,566,026 B2 7/2009 Lam et al.
7,834,300 B2 11/2010 Zemany et al.
8,669,505 B2 3/2014 Guibout et al.
9,086,258 B1 * 7/2015 Vasudevan ..... F42B 10/44
9,366,514 B1 6/2016 Barnard et al.
9,448,040 B2 * 9/2016 Rastegar ..... F41G 7/30
10,323,907 B1 6/2019 Wright
10,942,013 B2 3/2021 Zemany et al.
2004/0164202 A1 * 8/2004 Klestadt ..... F42B 10/54 244/3.23

(Continued)

FOREIGN PATENT DOCUMENTS

WO 2020072153 A1 4/2020

*Primary Examiner* — Bernarr E Gregory
(74) *Attorney, Agent, or Firm* — Scott J. Asmus

(57) ABSTRACT

Techniques are provided for guiding a projectile. A methodology implementing the techniques according to an embodiment includes generating a roll command based on a roll angle obtained from a steering map that causes a change in range and cross range of the projectile that results in a ground motion closest to a desired ground motion. The method also includes calculating a remaining maximum maneuver distance for the projectile, over a time period extending from the current time of flight to the end of flight. The calculation is based on integration a series of maximum maneuvers, obtained from the steering map, at time intervals within the time period. The method further includes generating a lift command for the projectile based on: distance between the target location and an impact point prediction (IPP) calculated at the current time of flight; an error estimate of the IPP; and the remaining maximum maneuver distance.

20 Claims, 10 Drawing Sheets

(56) References Cited

U.S. PATENT DOCUMENTS

| | | | | |
|---|---|---|---|---|
| 2020/0340787 | A1* | 10/2020 | Zemany | F42B 10/02 |
| 2021/0231406 | A1 | 7/2021 | Zemany et al. | |
| 2021/0231424 | A1 | 7/2021 | Zemany et al. | |
| 2021/0231425 | A1 | 7/2021 | Zemany et al. | |

* cited by examiner

BALLISTIC GUIDANCE SYSTEM

FIELD OF DISCLOSURE

The present disclosure relates to ballistic projectile guidance, and more particularly, to a process for controlling the roll and lift of a projectile based on predicted impact error estimates and remaining projectile maneuverability.

BACKGROUND

Ballistic projectiles are typically limited in their maneuverability as they lack self-propulsion and rely on adjustments to flight control surfaces that provide a limited maneuver at the expense of reduced range. This limit is due, at least in part, to a size restriction of the control surfaces imposed by fight stability, a loss of range caused by steering, and the effects of projectile spin and Magnus force. The control process is challenging, as there is a complex relationship between any changes in impact location and the control actions that must be taken to determine the optimal steering commands.

Figure 1:
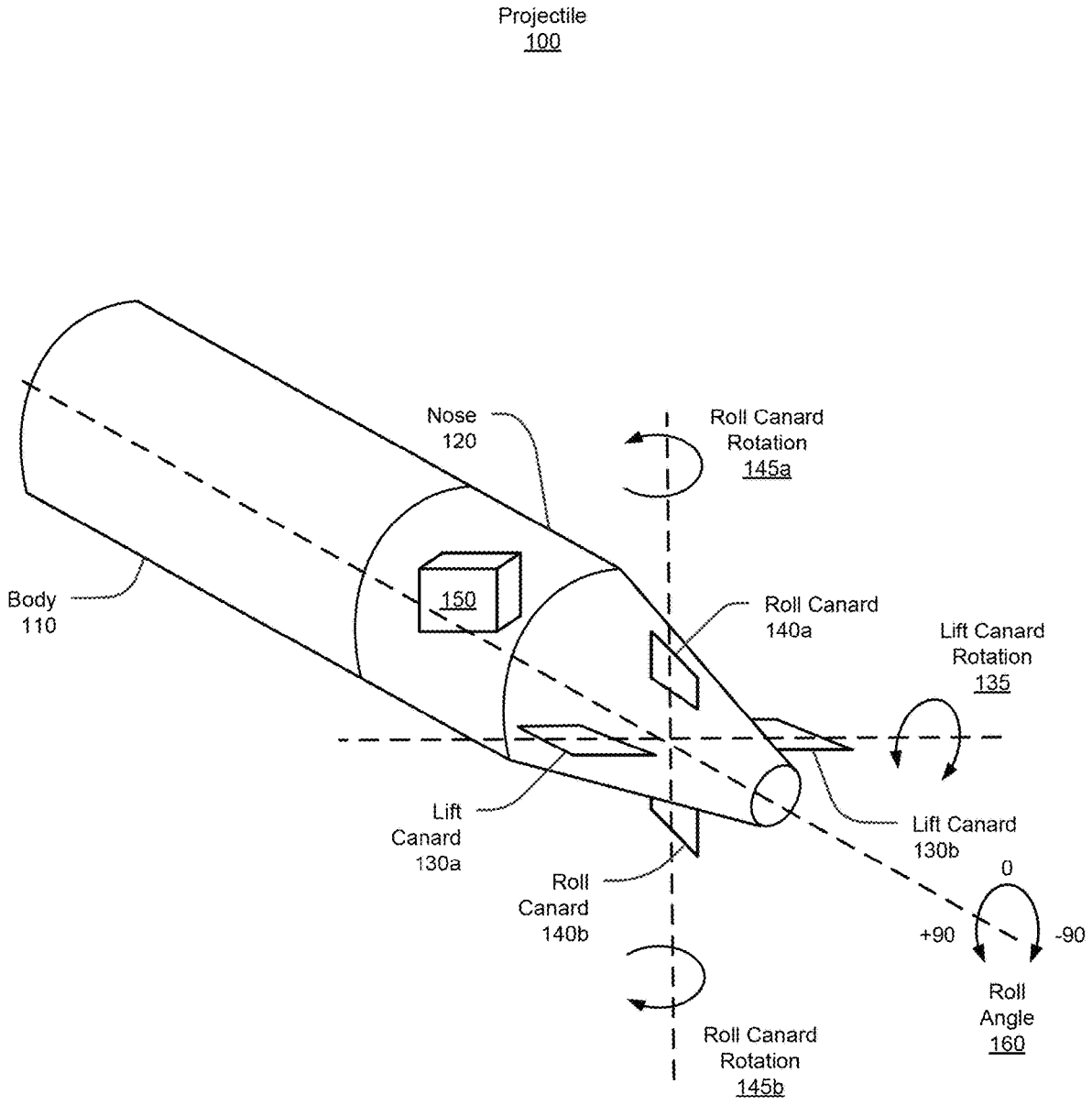
FIG. 1 illustrates a projectile, in accordance with certain embodiments of the present disclosure.

Although the following Detailed Description will proceed with reference being made to illustrative embodiments, many alternatives, modifications, and variations thereof will be apparent in light of this disclosure.

DETAILED DESCRIPTION

A ballistic projectile guidance system is described herein. As noted above, guided ballistic projectiles are typically limited in their maneuverability after launch, especially those that lack any means of self-propulsion (or that have only limited propulsion) and rely instead on adjustments to flight control surfaces, known as canards, to modify their flight path. A guidance control process to provide maneuverability of the projectile in flight is important to achieve an impact closer to the target than would otherwise occur, but the process is challenging due to the complexity of flight dynamics. For example, there is a complex time dependent relationship between any changes in impact location and the control actions that may be taken to effect those changes, and that relationship changes over the course of flight. The complexity arises mainly from ballistic geometry, Magnus forces and moments, and drag caused by the canard deflections.

To this end, a guidance control system according to an example is configured to control corrective maneuvers of the projectile, by adjusting roll and lift canards, to reduce the distance between the impact point and the location of the target. In one such example, maneuvers to change projectile range and cross range are performed at maneuver update intervals over the flight time of the projectile. The maneuver commands are based on a maximum maneuver that the projectile is capable of achieving at the current time of flight (e.g., at the time since launch) and on the remaining maneuver that is possible during the remaining time of flight until impact and the accuracy of an estimate of the correction needed to impact the target. This allows for more effective guidance that includes a larger effective maneuver envelope and increased operational range, as will be explained in greater detail below.

In some examples, a system to implement the disclosed techniques can be hosted on, or otherwise be incorporated into a ballistic projectile that may be launched from a platform such as an artillery piece, a tank, an aircraft, a ship, or other such weapon system platform. In accordance with an embodiment, a methodology to implement these techniques includes generating roll and lift commands. The roll command is employed to control roll canards of the projectile based on a roll angle obtained from a steering map. The roll angle is selected from the steering map to cause a change in range of the projectile and a change in cross range of the projectile that results in a ground motion of the projectile (e.g., the motion of the projectile relative to the ground), at a current time of flight, that is closest to a desired ground motion, relative to other roll angle entries in the steering map. With respect to lift, the method includes calculating a remaining maximum maneuver distance for the projectile over a time period extending from the current time of flight to an ending time of flight. The calculation is based on an integration of a series of maximum maneuvers, each of the maximum maneuvers obtained from the steering map, at a time interval within the time period. So, with respect to lift, the method further includes generating a lift command to control lift canards of the projectile based on: (1) a distance between the target location and an impact point prediction (IPP) of the projectile calculated at the current time of flight; (2) an estimate of error in the IPP; and (3) the remaining maximum maneuver distance.

It will be appreciated that the techniques described herein for projectile guidance may provide improved targeting accuracy with more effective impact results, compared to existing techniques that rely on just firing elevation of the launch platform and initial projectile velocity to aim the projectile towards the target. The disclosed techniques increase the efficiency of the steering process which allows for correction of larger miss errors and dispersion caused by wind, launch errors and other disturbances. The techniques disclosed herein may further be implemented in hardware or software or a combination thereof. Numerous embodiments and applications will be apparent in light of this disclosure.

Projectile Guidance Overview

FIG. 1 illustrates a projectile 100, in accordance with certain embodiments of the present disclosure. The projectile 100 is shown to include a body portion 110 and a nose portion 120. In some embodiments, the body 110, also referred to as a munition body, may carry an explosive charge configured to explode or detonate upon impact at or near a target. In other embodiments, the body 110 may carry a more localized payload or a non-lethal payload. The body 110 is configured to spin during flight to provide gyroscopic and aerodynamic stabilization to improve range and accuracy.

The nose portion 120 is shown to include lift canards 130*a*, 130*b*, roll canards 140*a*, 140*b*, and projectile guidance system 150. The projectile guidance system 150 is configured to control the canards during flight, as will be described in greater detail below. The nose portion 120 is coupled to the body portion 110 in a manner that allows it to rotate independently of the body portion, for example under control of the roll canards 140*a*, 140*b*. Roll canard 140*a* is configured to rotate about an axis as shown by roll canard rotation 145*a*. Roll canard 140*b* is configured to rotate about an axis as shown by roll canard rotation 145*b*, which is generally in the opposite direction from rotation 145*a*. Rotation of the roll canards to a particular opposing orientation allows the nose to spin towards a desired roll angle 160. Upon achieving the desired roll angle 160, the roll canards 140 can be commanded to revert to an orientation that allows the nose to remain in a de-spun state at the desired roll angle.

Lift canards 130*a*, 130*b* are configured to rotate in the same direction about an axis as shown by lift canard rotation 135. The angle to which the lift canards are rotated, in combination with the roll angle, determines how the projectile will be steered. For example, near the end of flight, if the roll angle is zero degrees (so that the axis of the roll canard rotation is vertical, as shown in the figure) then the lift canards will steer the projectile either increase range or decrease range. However, if the roll angle is rotated ninety degrees, then the lift canards will steer the projectile to the left or right. In earlier portions of the flight, Magnus and projectile spin effects can significantly modify the impact position by rotating or shifting the impact pattern. The steering map is used to account for this.

Figure 2:
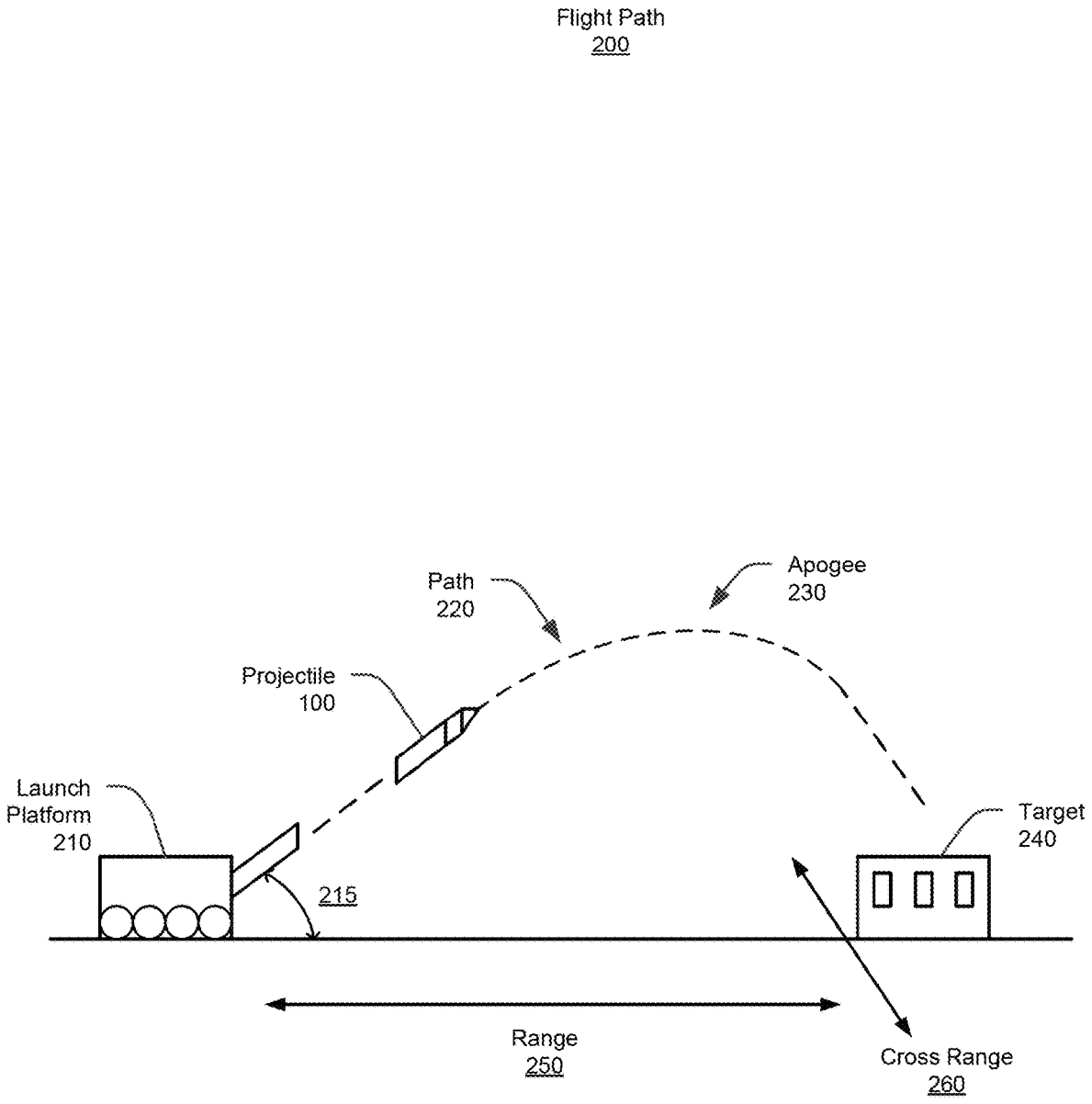
FIG. 2 illustrates a projectile flight path, in accordance with certain embodiments of the present disclosure.

FIG. 2 illustrates a projectile flight path 200, in accordance with certain embodiments of the present disclosure. A launch platform 210 is shown to fire the projectile 100, which then follows a ballistic path or trajectory 220 upwards to an apogee point 230 and then back down towards the target 240. The elevation 215 of the muzzle and the quantity of explosive charge used to fire the projectile (providing the initial projectile velocity) are chosen to provide an initial aiming of the projectile towards the target. Range 250 and cross range 260 dimensions are also shown to illustrate the how the location of the projectile impact relative to the launch platform may vary along these orthogonal dimensions. For example, the range 250 may be short or long of the target, resulting in a miss by some distance in range. Likewise, the cross range 260 may be left or right of the target resulting in a miss by some distance in cross range.

After launch, the projectile guidance system 150 controls the canards 135 and 140 to adjust range and cross range to steer the projectile in a manner that reduces the miss distance to the target, based on aerodynamics and other factors, as will be described below.

System Architecture

Figure 3:
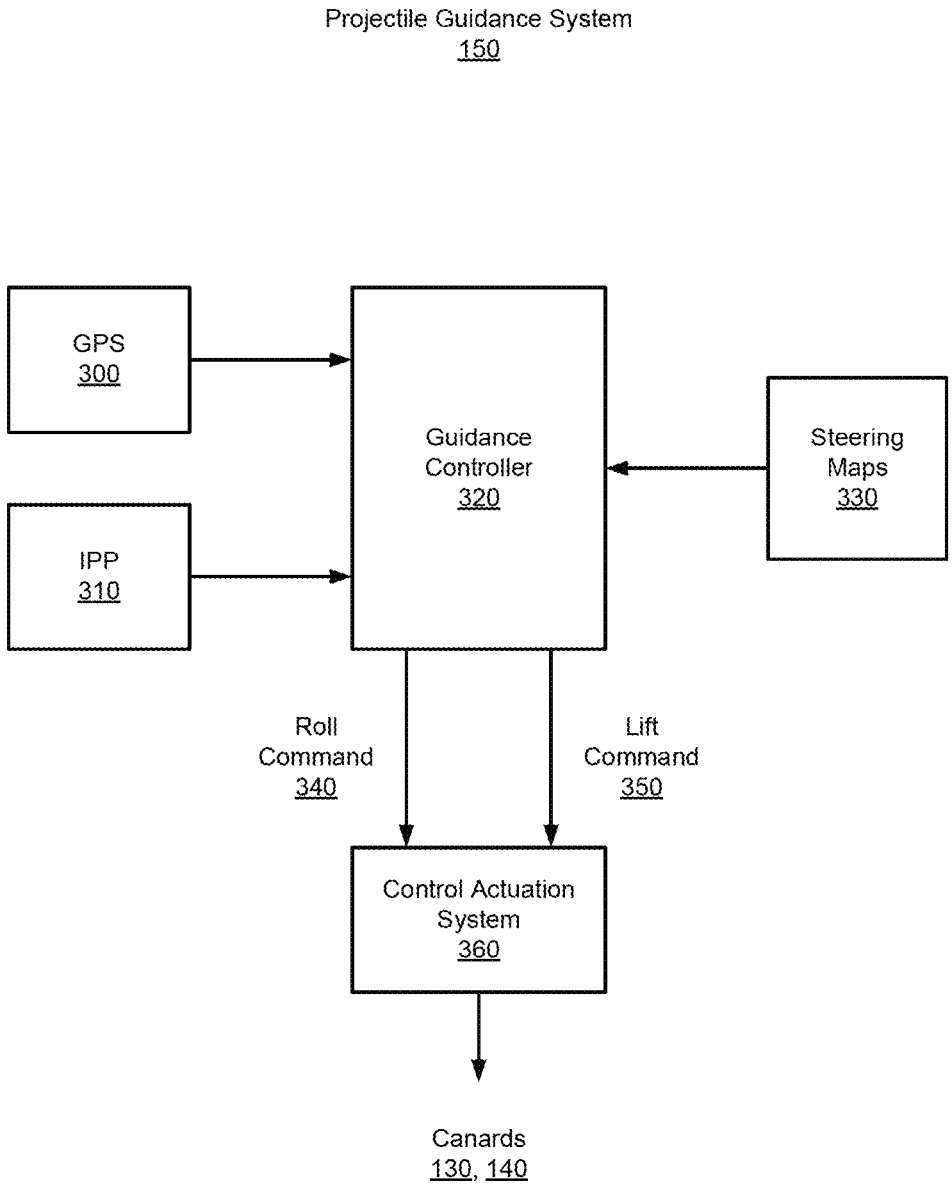
FIG. 3 is a block diagram of a projectile guidance system, configured in accordance with certain embodiments of the present disclosure.

FIG. 3 is a block diagram of a projectile guidance system 150, configured in accordance with certain embodiments of the present disclosure. The projectile guidance system 150 is shown to include a global positioning system (GPS) receiver 300, an impact point predictor (IPP) 310, a guidance controller 320, and a control actuator system 360. Tables of steering maps 330 are also provided (e.g., in memory or other storage) for use by the guidance controller 320. Operation of the guidance controller 320 will be described in greater detail below, but at a high level, the guidance controller is configured to generate and update roll commands 340 and lift commands 350 throughout the flight. The roll and lift commands are provided to the control actuation system 360 to effect changes in the orientation of the roll canards 140 and lift canards 130 (e.g., through the action of motors, pneumatics, or the like) such that the path of the projectile is changed in flight to guide it towards the target.

The guidance controller may generate updates to the roll and lift commands at periodic intervals during the flight. For example, in some embodiments, the commands may be updated once per second between the time of launch and the time of impact (or end of flight), although other update intervals may be used. The guidance controller generates these command updates based, at least in part, on the position of the projectile (at the update time), a prediction of the point of impact (that is calculated at the update time), and steering maps which provide information about the maneuverability of the projectile (at the update time), as will be described below.

In some embodiments, the position of the projectile is obtained from a GPS receiver 300, although other suitable sensors or mechanisms (e.g., inertial navigation systems) may also be used.

The impact point predictor (IPP) 310 is configured to make a prediction of the projectile impact location assuming no further guidance corrections are made. This is also referred to as the zero effort miss. The IPP 310 is run at each update time, during the course of the flight, and uses the current projectile position (e.g., based on GPS) in combination with an aerodynamic model of the projectile to model the future path or trajectory of the projectile until impact. Any suitable IPP may be used, in light of the present disclosure.

The steering map is a collection of tables that provide the change in projectile impact position for a maximum lift canard deflection, for a given roll angle, at a given flight time (e.g., the time since launch). The values stored in the steering map depend on the type of projectile (e.g., aerodynamic characteristics, drag, etc.), the firing elevation angle, and the launch velocity of the projectile as it leaves the muzzle. As such, a particular steering map may be preselected from the collection of available steering maps based on the projectile type, the firing elevation, and the launch velocity, all of which are known ahead of time. In some embodiments, the steering map may also be computed by the projectile flight processor just prior to launch. The projectile impact position in one example is a ground impact position which refers to a ground or sea based location for the impact of the projectile, allowing for targeting of ground based or sea based assets such as vehicles, ships, or ground based aircraft.

Each steering map comprises a range table and a cross range table. The range table provides the maximum possible change in range (dR) of the projectile and the cross range table provides the maximum possible change in cross range (d×R) of the projectile, as a function of roll angle PHI and flight time TF. For example:

$$dR=\text{SteeringMapRangeTable}(PHI,TF)$$

$$d\times R=\text{SteeringMapCrossRangeTable}(PHI,TF)$$

In some embodiments, these values (dR and d×R) represent the change in ground impact position effected by the application of a command calling for maximum canard deflection for one second, starting at time TF and lasting until time TF+1 seconds, where the steering map table resolution is one second. One second is an example, and other values of time resolution are possible design parameters.

In some embodiments, the steering maps are generated from aerodynamic simulations, 3 degree-of-freedom (DOF) models, 6 DOF models, wind tunnel experiments, or by any other suitable means in light of the present disclosure. These maps can be precomputed and downloaded just prior to launch or computed by the projectile flight processor just prior to launch.

Figure 4:
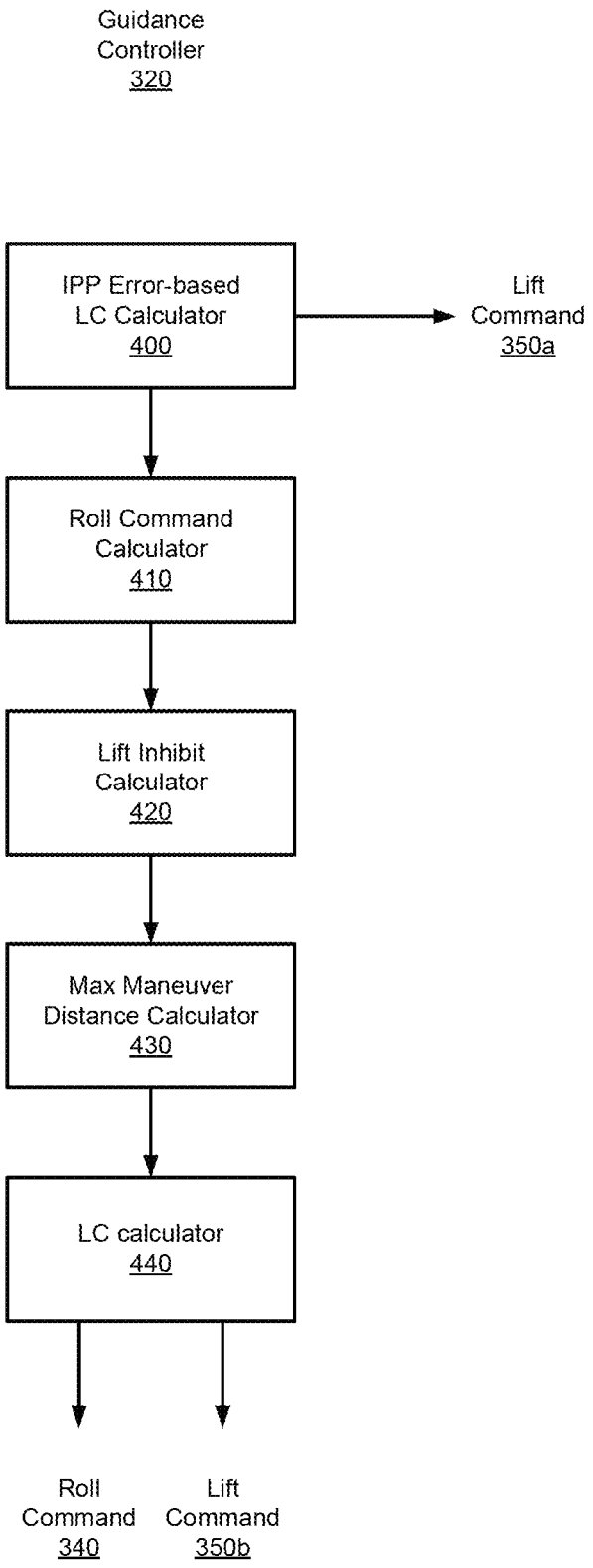
FIG. 4 is a block diagram of a guidance controller of the projectile guidance system of FIG. 3, configured in accordance with an embodiment of the present disclosure.

FIG. 4 is a block diagram of the guidance controller 320 of the projectile guidance system 150 of FIG. 3, configured in accordance with an embodiment of the present disclosure. The guidance controller 320 is shown to include an IPP error-based lift command calculator 400, a roll calculator 410, a lift inhibit calculator 420, a maximum maneuver distance calculator 430, and a lift command calculator 440.

The IPP error-based lift command calculator 400 is configured to calculate a lift command based on the expected error in the IPP prediction (e.g., the expected error in the predicted impact distance relative to the target. Operation of the IPP error-based lift command calculator 400 will be described in greater detail below in connection with FIG. 5. At a high level, however, the lift command is based on not just the predicted error (e.g., predicted miss distance), but also on the expected error in that prediction. For example, if the predicted miss distance is 10 meters, but the expected error in the prediction is greater than 10 meters, it may be beneficial to limit, or possibly prevent, any attempt at steering by reducing the impact of the lift command. This can avoid unnecessary steering and conserve energy.

The roll command calculator 410 is configured to compute a roll command to adjust the roll angle of the nose of the projectile, at the current time of flight, to account for drag and spin drift, which are factors that are incorporated in the steering maps. The lift inhibit calculator 420 is configured to determine whether or not any lift should be applied at the current time of flight. For example, if added drag resulting from the lift operation would decrease range, then the lift command might be inhibited. Operation of the roll command calculator 410 and the lift inhibit calculator 420 will be described in greater detail below in connection with FIG. 6.

The maximum maneuver distance calculator 430 is configured to employ the steering map to estimate or update the remaining projectile maneuverability in range and cross range, from the current time of flight to the end of flight. For example, if the total remaining maneuver distance is large compared to the miss distance that would result from taking no action, then a maximum lift canard command is not used since there is excess maneuver available to hit the target. This prevents loss of range and saves maneuver and energy for small corrections as the projectile nears the target. However, if the remaining maneuverability is comparable to the expected miss it would be necessary to use a maximum lift command. Computation done by the maximum maneuver distance calculator 430 will be described in greater detail below in connection with FIG. 7.

The lift command calculator 440 is configured to calculate a lift command based on one or more of the IPP predicted miss calculated at the current time of flight, an estimate of the error in the IPP prediction, and the estimate of the remaining maximum maneuver distance. Operation of the lift command calculator 440 will be described in greater detail below in connection with FIG. 8.

Methodology

Figure 5:
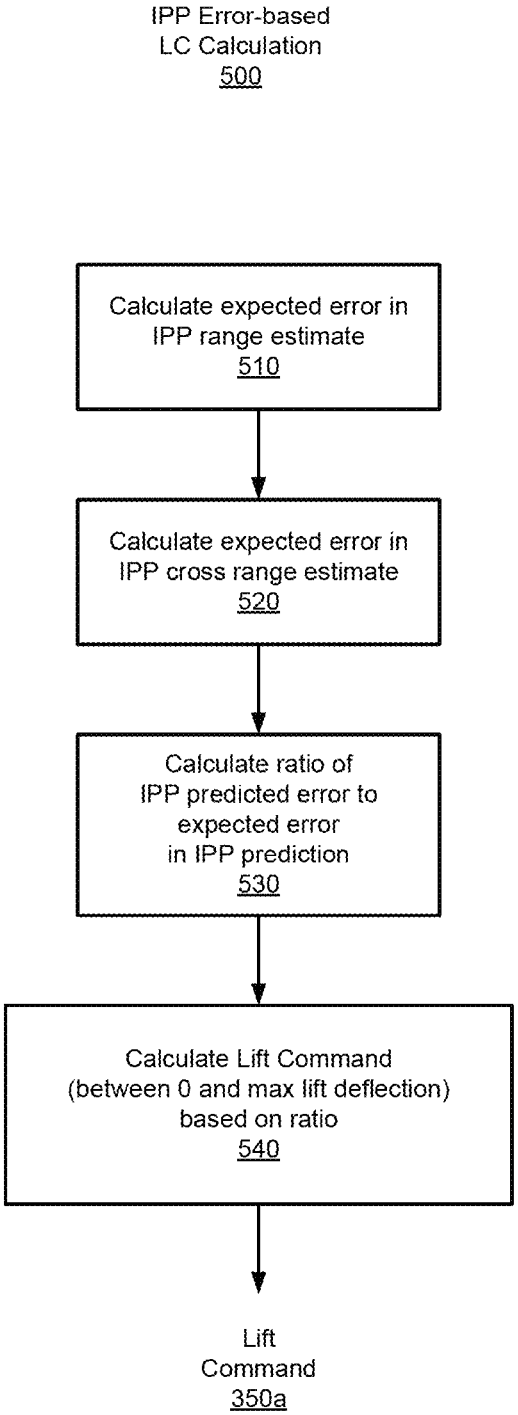
FIG. 5 is a flowchart illustrating a methodology for operation of the impact point prediction (IPP) error-based lift command (LC) calculator of FIG. 4, in accordance with an embodiment of the present disclosure
Figure 6:
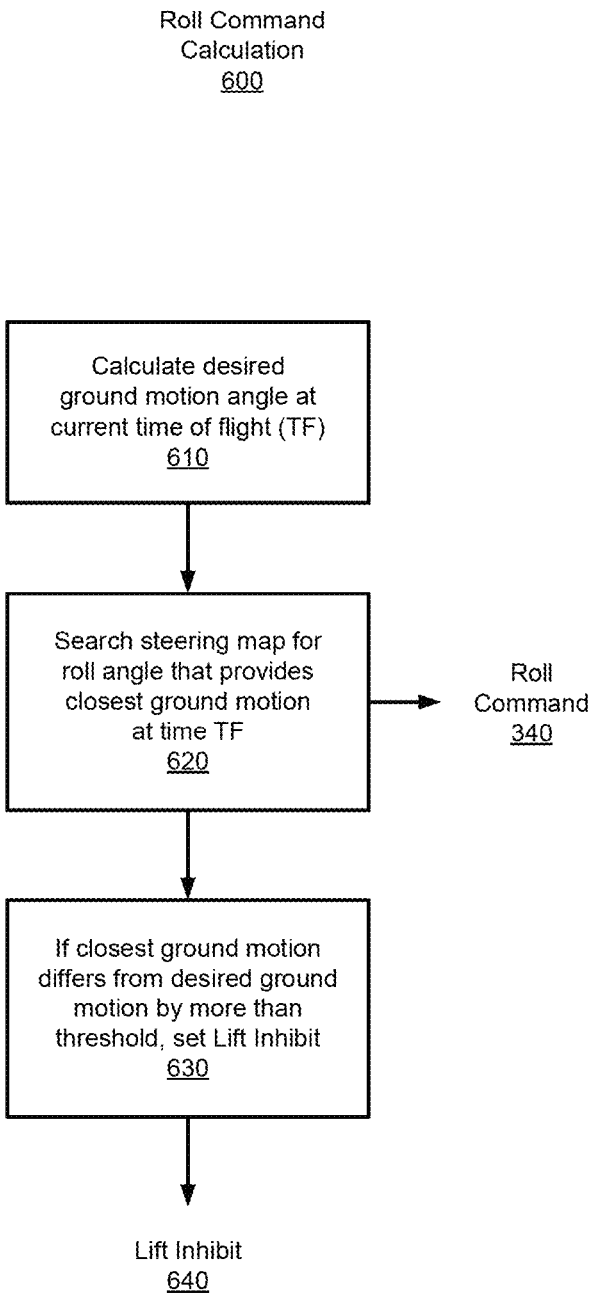
FIG. 6 is a flowchart illustrating a methodology for operation of the roll command calculator of FIG. 4, in accordance with an embodiment of the present disclosure.
Figure 7:
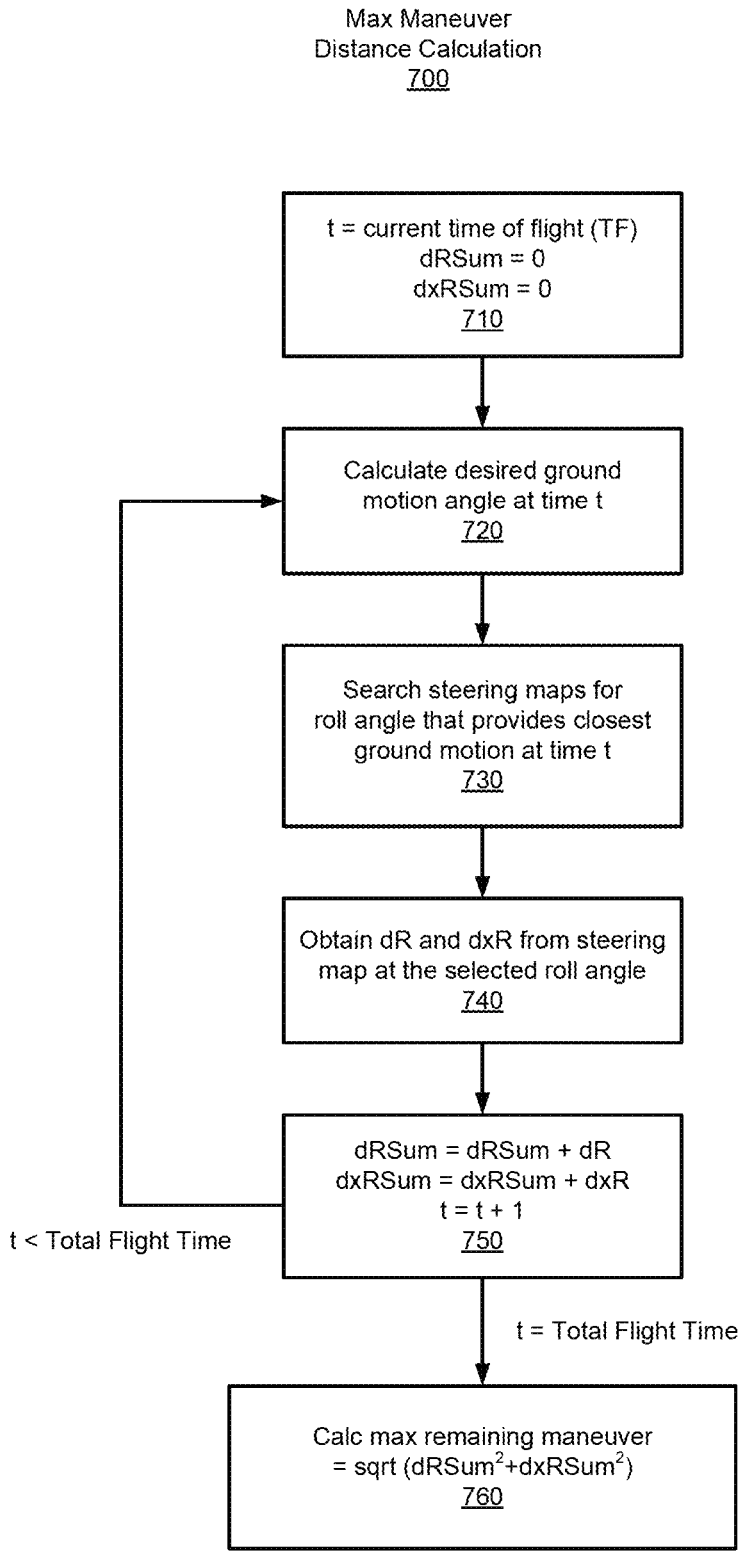
FIG. 7 is a flowchart illustrating a methodology for operation of the maximum maneuver distance calculator of FIG. 4, in accordance with an embodiment of the present disclosure.
Figure 8:
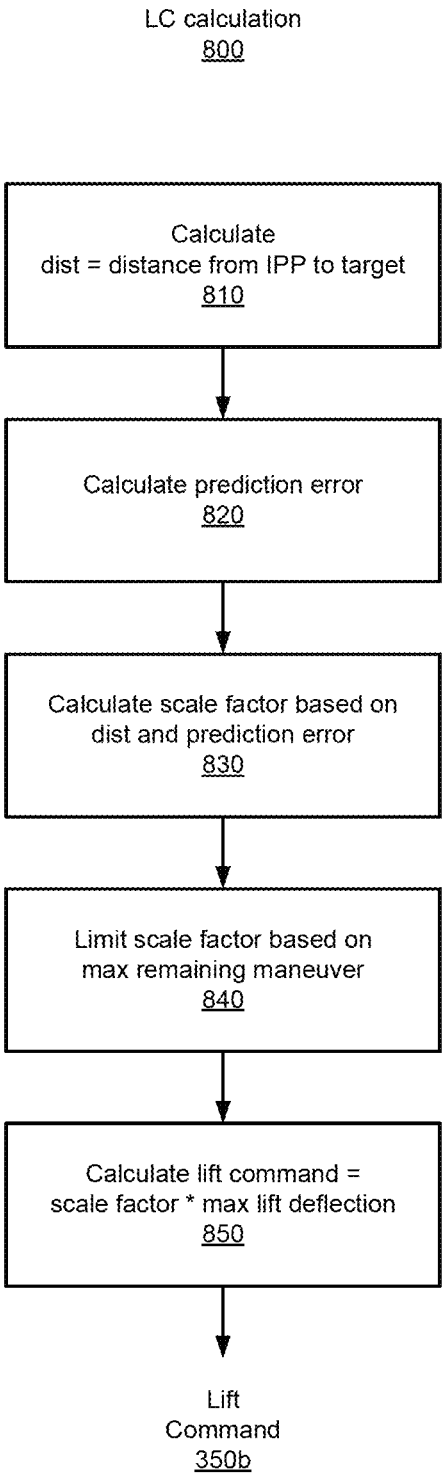
FIG. 8 is a flowchart illustrating a methodology operation of the lift command calculator of FIG. 4, in accordance with an embodiment of the present disclosure.
Figure 9:
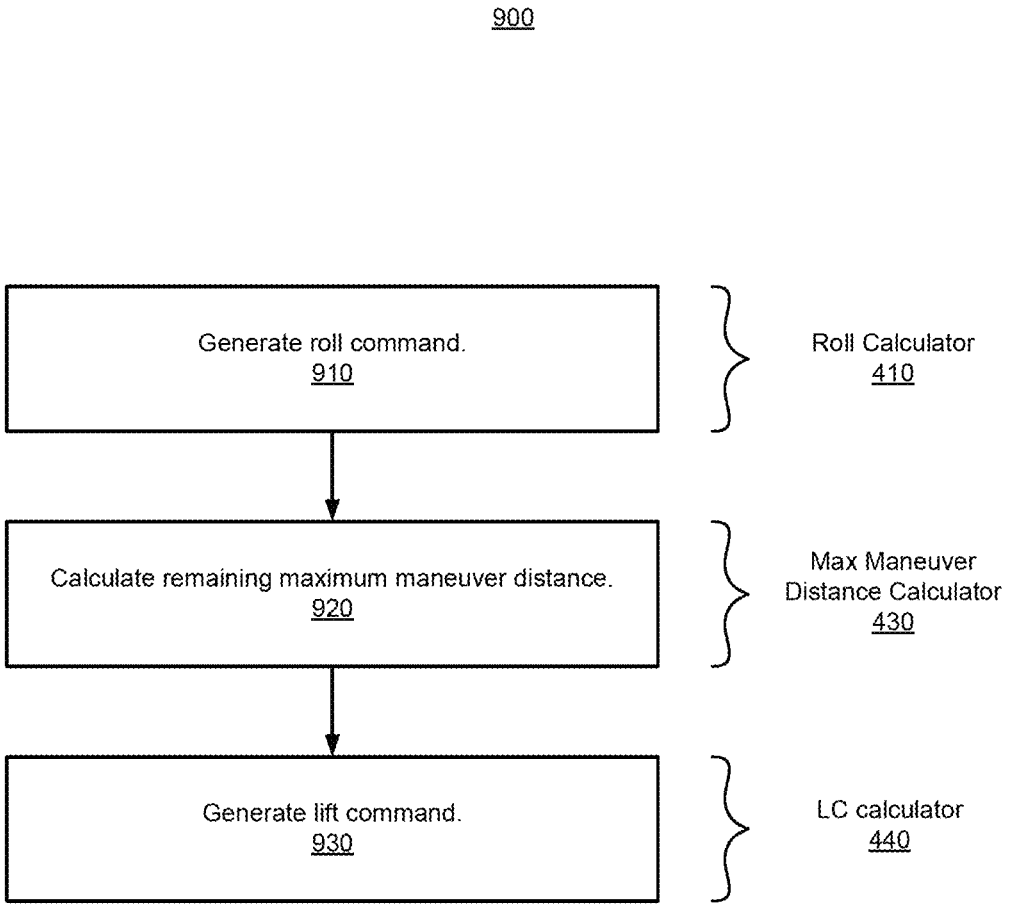
FIG. 9 is a flowchart illustrating a methodology for guiding a projectile, in accordance with an embodiment of the present disclosure.

FIG. 5 is a flowchart illustrating a methodology 500 for operation of the IPP error-based lift command calculator 400, in accordance with an embodiment of the present disclosure. FIG. 6 is a flowchart illustrating a methodology 600 for operation of the roll command calculator 410, in accordance with an embodiment of the present disclosure. FIG. 7 is a flowchart illustrating a methodology 700 for operation of the maximum maneuver distance calculator 430, in accordance with an embodiment of the present disclosure. FIG. 8 is a flowchart illustrating a methodology 800 operation of the lift command calculator 440, in accordance with an embodiment of the present disclosure. FIG. 9 is a flowchart illustrating a methodology 900 for guiding a projectile, in accordance with an embodiment of the present disclosure. As can be seen, the example methods include a number of phases and sub-processes, the sequence of which may vary from one embodiment to another. However, when considered in aggregate, these phases and sub-processes form a process for projectile guidance, in accordance with certain of the embodiments disclosed herein. These embodiments can be implemented, for example using the system architecture illustrated in FIGS. 1-4, as described above. However other system architectures can be used in other embodiments, as will be apparent in light of this disclosure. To this end, the correlation of the various functions shown in FIGS. 5-9 to the specific components illustrated in FIGS. 1-4, is not intended to imply any structural and/or use limitations. Rather other embodiments may include, for example, varying degrees of integration wherein multiple functionalities are effectively performed by one system. Numerous variations and alternative configurations will be apparent in light of this disclosure.

As illustrated in FIG. 5, in one embodiment, method 500 for operation of the IPP error-based lift command calculator 400, commences at operation 510, by calculating an expected error (ER) in the IPP range estimate and, at operation 520, calculating an expected error (E×R) in the IPP cross range estimate. In some embodiments, ER and E×R are calculated as:

$$ER=\text{Range}*AR$$

$$E\times R=\text{Range}*A\times R$$

where AR and A×R are scale factors that relate the expected prediction errors to range such that the expected prediction errors decrease as the range to the target decreases, as would be expected since prediction error is generally larger when the distance to the target is greater. In some embodiments, AR is a value on the order of 0.03 radians and A×R is a value on the order of 0.02 radians. The range to target may be calculated as:

$$\text{Range}=\text{sqrt}((Tx-Px)^2+(Ty-Py)^2+(Tz-Pz)^2)$$

where (Tx,Ty,Tz) is the known target position and (Px,Py, Pz) is the current projectile position. In some embodiments, the projectile position is obtained from GPS. In some embodiments, the projectile position can be calculated or extrapolated from the initial flight path (e.g., trajectory) and the time since launch.

At operation 530, a ratio of the IPP predicted error (e.g., the target miss distance in range IR and cross range I×R) to the expected error in the IPP prediction (ER and E×R) is calculated. In some embodiments, IR and I×R are calculated as:

$$IR=\text{Ipp}R-Tx$$

$$I\times R=\text{Ipp}\times R-Ty$$

where IppR is the IPP range prediction and Ipp×R is the IPP cross range prediction, and the values are expressed in a range and cross range reference frame. The error ratio (RE) may then be calculated as:

$$RE=\text{sqrt}(IR^2+I\times R^2)/\text{sqrt}(ER^2+E\times R^2)$$

At operation 540, a lift value is calculated which can take on values between zero lift and the maximum possible lift deflection of the projectile, Liftmax, based on the error ratio. In some embodiments, the lift value, Lift, is calculated as:

$$\text{Lift}=0, \text{ if } RE<a,$$

$$\text{Lift}=\text{Liftmax}, \text{ if } RE>b, \text{ else}$$

$$\text{Lift}=(\text{Liftmax}/(b-a))*(RE-a), \text{ a uniform ramp between the 0 and Liftmax}$$

where a is a first threshold value that defines a value of RE where the ramp starts, and b is a second threshold value that defines a value of RE where the ramp ends. In some embodiments, a=0.75 and b=3.0. A lift command 350*a* is then generated for the control actuation system 360 to cause the lift canards to provide the calculated lift value.

In some embodiments, the lift command 350*a* calculated in this manner, at operation 540, may be particularly useful for controlling the projectile at a relatively early stage in flight, when the range to the target is greatest and the error in the IPP prediction is relatively larger than it would be at later points in the flight, as the projectile nears the target.

As illustrated in FIG. 6, in one embodiment, method 600 for operation of the roll command calculator 410, commences at operation 610, by calculating a desired ground motion angle of the projectile at the current time of flight (TF). In some embodiments, the desired ground motion angle AngleGM is calculated as:

$$\text{Angle}GM=\text{atan2}(I\times R,IR)$$

where, for example, $$AngleGM = 0 \text{ is straight ahead,}$$
$$= 90 \text{ degrees is right of target, and}$$
$$= -90 \text{ degrees is left of target}$$

At operation 620, the steering map is searched for a roll angle (PHI) that provides a ground motion that is closest to the desired ground motion at time TF. In some embodiments, the search is described by the following pseudo-code:

For each PHI in the Steering Map:

$$dR=\text{SteeringMapRangeTable}(PHI,TF)$$

$$d\times R=\text{SteeringMapCrossRangeTable}(PHI,TF)$$

$$\text{Angle}GM'=\text{atan2}(d\times R,dR)$$

$$\text{diff}=\text{abs}(\text{Angle}GM-\text{Angle}GM')$$

if diff is smallest, save PHI as the roll angle resulting from the search

A roll command 340 is then generated for the control actuation system 360 to cause the roll canards to rotate the nose to roll angle PHI.

At operation 630, a lift inhibit command 640 is generated if the closest ground motion differs from the desired ground motion by more than a threshold value (e.g., if the smallest diff that is found is greater than the threshold value). In some embodiments, the threshold value is in the range of 10 to 20 degrees. This situation may arise in cases where added atmospheric drag, resulting from a desired change in lift, may not allow for a desired range increase at the current time in flight, and so it is better to leave the lift unchanged.

As illustrated in FIG. 7, in one embodiment, method 700 for operation of the maximum maneuver distance calculator 430, commences at operation 710, by initializing a time variable t to the current time of flight TF, initializing the range summation dRSum to zero, and initializing the cross range summation d×RSum to zero. The range summation variable dRSum is used to accumulate the maximum range maneuver over the remaining flight time and the cross range summation d×RSum is used to accumulate the maximum cross range maneuver over the remaining flight time.

At operation 720, the desired ground motion angle, AngleGM, is calculated for time t. In some embodiments AngleGM is calculated as:

$$\text{Angle}GM=\text{atan2}(I\times R,IR)$$

where I×R and IR are updated by the IPP at time t.

At operation 730, the steering map is searched for a roll angle (PHI) that provides a ground motion that is closest to the desired ground motion at time t. In some embodiments, the search is described by the following pseudo-code:

For each PHI in the Steering Map:

$$dR=\text{SteeringMapRangeTable}(PHI,t)$$

$$d\times R=\text{SteeringMapCrossRangeTable}(PHI,t)$$

$$\text{Angle}GM'=\text{atan2}(d\times R,dR)$$

$$\text{diff}=\text{abs}(\text{Angle}GM-\text{Angle}GM')$$

if diff is smallest, save dR and d×R

At operation 740, dR and d×R are obtained from the steering map at the roll angle PHI associated with the smallest difference between ground motion AngleGM' and desired ground motion AngleGM.

At operation 750, dRSum is increased by dR, d×RSum is increased by d×R, and time t is incremented. If t is less than the total flight time, the process loops back to operation 720 to continue integrating the range and cross range maneuverability. Otherwise, at operation 760, the maximum remaining maneuver from the predicted impact point towards the target, distmax, is calculated as:

$$\text{distmax}=\text{sqrt}(dR\text{Sum}2+d\times R\text{Sum}2)$$

As illustrated in FIG. 8, in one embodiment, method 800 for operation of the lift command calculator 440, commences at operation 810, by calculating the distance, dist, from the predicted impact point to the target. In some embodiments, dist may calculated as:

$$\text{dist}=\text{sqrt}(IR^2+I\times R^2)$$

At operation 820, the prediction error, prederror, is calculated. In some embodiments, prederror may calculated as:

$$\text{prederror}=\text{sqrt}(ER^2+E\times R^2)$$

At operation 830, a scale factor, scale, is calculated based on the distance and prediction error. In some embodiments, scale may calculated as:

$$\text{scale}=\min(1,(\text{dist}/\text{prederror})^2)$$

At operation 840, the scale factor is limited to unity if the distance, dist, exceeds the maximum remaining maneuver, distmax, by a pre-determined amount. For example, in some embodiments, the scale factor may be limited as follows:

$$\text{If dist}>P1*\text{distmax then scale}=1$$

Where P1 is a design parameter that may be determined through simulations. In some embodiments, P1 may be on the order of 0.75.

At operation 850, a lift value is calculated based on the maximum possible lift deflection of the projectile, Liftmax, scaled by the scale factor, scale. In some embodiments, the lift value, Lift, is calculated as:

$$\text{Lift}=\text{Liftmax}*\text{scale}$$

A lift command 350*b* is then generated for the control actuation system 360 to cause the lift canards to provide the calculated lift value. If, however, the lift inhibit command 640 was generated, at operation 630, then no lift command 350*b* is applied.

In some embodiments, the lift command 350*b* that is calculated in this manner, at operation 850, may be particularly useful for controlling the projectile at a relatively later stage in flight, as the projectile nears the target, when the range to the target is smaller and the error in the IPP prediction is relatively smaller than at earlier points in the flight.

As illustrated in FIG. 9, in one embodiment, method 900 for guiding a projectile, commences at operation 910, by generating a roll command to control roll canards of the projectile. The roll command is based on a roll angle, obtained from a steering map, that causes a change in range and cross range of the projectile which results in a ground motion of the projectile, at a current time of flight, that is closest to a desired ground motion, relative to other roll angle entries in the steering map. In some embodiments, the desired ground motion is based on a calculated range error and cross range error that is based on a difference between the target location and the IPP of the projectile calculated at the current time of flight.

At operation 920, a remaining maximum maneuver distance for the projectile is calculated, over a time period extending from the current time of flight to an ending time of flight. The calculation is based on an integration of a series of maximum maneuvers, obtained from the steering map, at a number of time intervals within the time period.

At operation 930, a lift command is generated to control lift canards of the projectile based on one or more of (1) a distance between the target location and an impact point prediction (IPP) of the projectile calculated at the current time of flight, (2) an estimate of error in the IPP, and (3) the remaining maximum maneuver distance.

In some embodiments, the estimate of error in the IPP comprises an estimate of range error in the IPP and an estimate of cross range error in the IPP. The estimate of range error in the IPP is proportional, by a first scale factor, to a calculated range to the target, and the estimate of cross range error in the IPP is proportional, by a second scale factor, to the calculated range to the target. These scale factors can represent an angle error, however other methods can also be used to provide error estimates. For example the estimated GPS errors (that come from the GPS covariance estimate) can be used to compute the expected IPP errors.

In some embodiments, the lift command is inhibited if the direction of ground motion defined by an angle of the projectile associated with the roll angle obtained from the steering map differs from the desired ground motion by more than a threshold value. In some embodiments, the threshold value is in the range of 10 to 20 degrees

Example System

Figure 10:
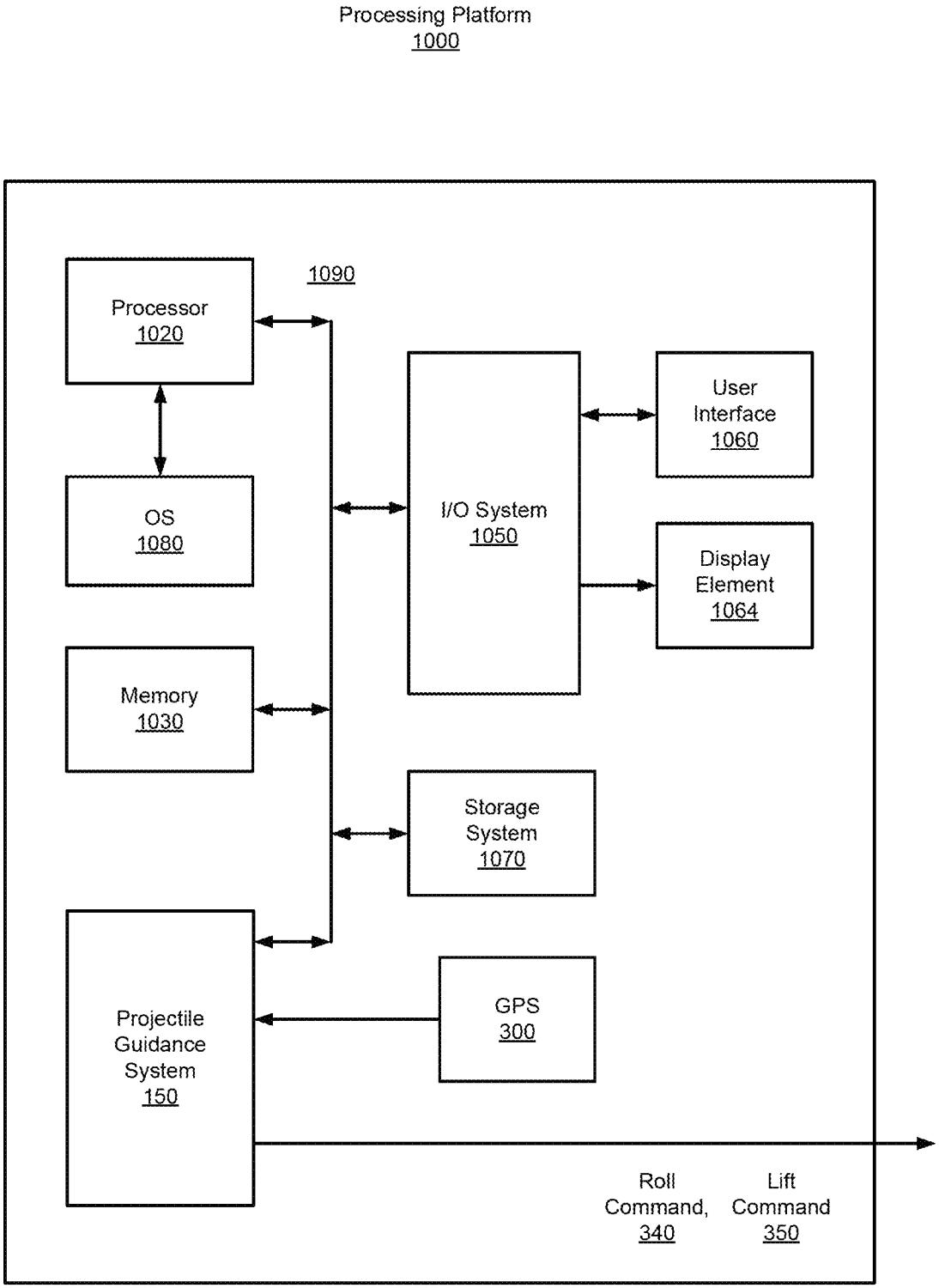
FIG. 10 is a block diagram of a platform for a projectile guidance system configured in accordance with an embodiment of the present disclosure.

FIG. 10 is a block diagram of a platform 1000 for a projectile guidance system configured in accordance with an embodiment of the present disclosure. In some embodiments, platform 1000, or portions thereof, may be hosted on, or otherwise be incorporated into a ballistic projectile configured to deliver munitions to a target.

In some embodiments, platform 1000 may comprise any combination of a processor 1020, a memory 1030, an input/output (I/O) system 1050, a user interface 1060, a display element 1064, a storage system 1070, the projectile guidance system 150, and the GPS receiver 300. As can be further seen, a bus and/or interconnect 1090 is also provided to allow for communication between the various components listed above and/or other components not shown. Other componentry and functionality not reflected in the block diagram of FIG. 10 will be apparent in light of this disclosure, and it will be appreciated that other embodiments are not limited to any particular hardware configuration.

Processor 1020 can be any suitable processor, and may include one or more coprocessors or controllers, such as an audio processor, a graphics processing unit, or hardware accelerator, to assist in control and processing operations associated with platform 1000. In some embodiments, the processor 1020 may be implemented as any number of processor cores. The processor (or processor cores) may be any type of processor, such as, for example, a microprocessor, an embedded processor, a digital signal processor (DSP), a graphics processor (GPU), a tensor processing unit (TPU), a network processor, a field programmable gate array or other device configured to execute code. The processors may be multithreaded cores in that they may include more than one hardware thread context (or "logical processor") per core. Processor 1020 may be implemented as a complex instruction set computer (CISC) or a reduced instruction set computer (RISC) processor. In some embodiments, processor 1020 may be configured as an x86 instruction set compatible processor.

Memory 1030 can be implemented using any suitable type of digital storage including, for example, flash memory and/or random-access memory (RAM). In some embodiments, the memory 1030 may include various layers of memory hierarchy and/or memory caches. Memory 1030 may be implemented as a volatile memory device such as, but not limited to, a RAM, dynamic RAM (DRAM), or static RAM (SRAM) device. Storage system 1070 may be implemented as a non-volatile storage device such as, but not limited to, one or more of a hard disk drive (HDD), a solid-state drive (SSD), a universal serial bus (USB) drive, an optical disk drive, tape drive, an internal storage device, an attached storage device, flash memory, and/or battery backed-up synchronous DRAM (SDRAM). In some embodiments, storage 1070 may comprise technology to increase the storage performance enhanced protection for valuable digital media when multiple hard drives are included.

Processor 1020 may be configured to execute an Operating System (OS) 1080 which may comprise any suitable operating system, such as Google Android (Google Inc., Mountain View, CA), Microsoft Windows (Microsoft Corp., Redmond, WA), Apple OS X (Apple Inc., Cupertino, CA), Linux, or a real-time operating system (RTOS). As will be appreciated in light of this disclosure, the techniques provided herein can be implemented without regard to the particular operating system provided in conjunction with platform 1000, and therefore may also be implemented using any suitable existing or subsequently-developed platform.

I/O system 1050 may be configured to interface between various I/O devices and other components of platform 1000. I/O devices may include, but not be limited to, user interface 1060 and display element 1064. User interface 1060 may include devices (not shown) such as a touchpad, keyboard, and mouse, etc., for example, to allow the user to control the system during configuration or initialization prior to launch.

It will be appreciated that in some embodiments, the various components of platform 1000 may be combined or integrated in a system-on-a-chip (SoC) architecture. In some embodiments, the components may be hardware components, firmware components, software components or any suitable combination of hardware, firmware or software.

Projectile guidance system 150 is configured to adjust the projectile control surfaces (e.g., roll canards and lift canards) during flight to help guide the projectile to the target with increased reliability, as described previously. Projectile guidance system 150 may include any or all of the circuits/components illustrated in FIGS. 1-4, as described above. These components can be implemented or otherwise used in conjunction with a variety of suitable software and/or hardware that is coupled to or that otherwise forms a part of platform 1000.

Various embodiments may be implemented using hardware elements, software elements, or a combination of both. Examples of hardware elements may include processors, microprocessors, circuits, circuit elements (for example, transistors, resistors, capacitors, inductors, and so forth), integrated circuits, application-specific integrated circuits (ASICs, or other purpose-built semiconductor), programmable logic devices, digital signal processors, field programmable gate arrays (FPGAs), logic gates, registers, semiconductor devices, chips, microchips, chipsets, and so forth. Examples of software may include software components, programs, applications, computer programs, application programs, system programs, machine programs, operating system software, middleware, firmware, software modules, routines, subroutines, functions, methods, procedures, software interfaces, application program interfaces, instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power level, heat tolerances, processing cycle budget, input data rates, output data rates, memory resources, data bus speeds, and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still cooperate or interact with each other.

The various embodiments disclosed herein can be implemented in various forms of hardware, software, firmware, and/or special purpose processors. For example, in one embodiment at least one non-transitory computer readable storage medium has instructions encoded thereon that, when executed by one or more processors, cause one or more of the methodologies disclosed herein to be implemented. The instructions can be encoded using a suitable programming language, such as C, C++, object oriented C, Java, JavaScript, Visual Basic .NET, Beginner's All-Purpose Symbolic Instruction Code (BASIC), or alternatively, using custom or proprietary instruction sets. The instructions can be provided in the form of one or more computer software applications and/or applets that are tangibly embodied on a memory device, and that can be executed by a computer having any suitable architecture. The computer software applications disclosed herein may include any number of different modules, sub-modules, or other components of distinct functionality, and can provide information to, or receive information from, still other components. These modules can be used, for example, to communicate with input and/or output devices such as a display screen, a touch sensitive surface, and/or any other suitable device. Other componentry and functionality not reflected in the illustrations will be apparent in light of this disclosure, and it will be appreciated that other embodiments are not limited to any particular hardware or software configuration. Thus, in other embodiments platform 1000 may comprise additional, fewer, or alternative subcomponents as compared to those included in the example embodiment of FIG. 10.

The aforementioned non-transitory computer readable medium may be any suitable medium for storing digital information, such as a hard drive, a server, a flash memory, and/or random-access memory (RAM), or a combination of memories. In alternative embodiments, the components and/or modules disclosed herein can be implemented with hardware, including gate level logic such as a field-programmable gate array (FPGA), or alternatively, a purpose-built semiconductor such as an application-specific integrated circuit (ASIC). Still other embodiments may be implemented with a microcontroller having a number of input/output ports for receiving and outputting data, and a number of embedded routines for carrying out the various functionalities disclosed herein. It will be apparent that any suitable combination of hardware, software, and firmware can be used, and that other embodiments are not limited to any particular system architecture.

Some embodiments may be implemented, for example, using a machine readable medium or article which may store an instruction or a set of instructions that, if executed by a machine, may cause the machine to perform a method, process, and/or operations in accordance with the embodiments. Such a machine may include, for example, any suitable processing platform, computing platform, computing device, processing device, computing system, processing system, computer, process, or the like, and may be implemented using any suitable combination of hardware and/or software. The machine readable medium or article may include, for example, any suitable type of memory unit, memory device, memory article, memory medium, storage device, storage article, storage medium, and/or storage unit, such as memory, removable or non-removable media, erasable or non-erasable media, writeable or rewriteable media, digital or analog media, hard disk, floppy disk, compact disk read only memory (CD-ROM), compact disk recordable (CD-R) memory, compact disk rewriteable (CD-RW) memory, optical disk, magnetic media, magneto-optical media, removable memory cards or disks, various types of digital versatile disk (DVD), a tape, a cassette, or the like. The instructions may include any suitable type of code, such as source code, compiled code, interpreted code, executable code, static code, dynamic code, encrypted code, and the like, implemented using any suitable high level, low level, object oriented, visual, compiled, and/or interpreted programming language.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical entities within the registers, memory units, or other such information storage transmission or displays of the computer system. The embodiments are not limited in this context.

The terms "circuit" or "circuitry," as used in any embodiment herein, are functional structures that include hardware, or a combination of hardware and software, and may comprise, for example, singly or in any combination, hardwired circuitry, programmable circuitry such as computer processors comprising one or more individual instruction processing cores, state machine circuitry, and/or gate level logic. The circuitry may include a processor and/or controller programmed or otherwise configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., non-volatile) in memory devices. The circuitry may, collectively or individually, be embodied as circuitry that forms part of a larger system, for example, an integrated circuit (IC), an application-specific integrated circuit (ASIC), a system-on-a-chip (SoC), desktop computers, laptop computers, tablet computers, servers, smartphones, etc. Other embodiments may be implemented as software executed by a programmable device. In any such hardware cases that include executable software, the terms "circuit" or "circuitry" are intended to include a combination of software and hardware such as a programmable control device or a processor capable of executing the software. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be understood, however, that other embodiments may be practiced without these specific details, or otherwise with a different set of details. It will be further appreciated that the specific structural and functional details disclosed herein are representative of example embodiments and are not necessarily intended to limit the scope of the present disclosure. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

Example 1 is a projectile guidance controller comprising: a roll angle calculation circuit configured to generate a roll command to control roll canards of the projectile based on a roll angle, obtained from a steering map, that cause a change in range of the projectile and a change in cross range of the projectile that results in a ground motion of the projectile, at a current time of flight, that is closest to a desired ground motion, relative to other roll angle entries in the steering map; a maneuver distance calculation circuit coupled to an output of the roll angle calculation circuit and configured to calculate a remaining maximum maneuver distance for the projectile, over a time period extending from the current time of flight to an ending time of flight, the calculation based on an integration of a series of maximum maneuvers, each of the maximum maneuvers obtained from the steering map, at a time interval within the time period; and a lift calculation circuit coupled to an output of the maneuver distance calculation circuit and configured to generate a lift command to control lift canards of the projectile based on one or more of (a) a distance between a target location and an impact point prediction (IPP) of the projectile calculated at the current time of flight, (b) an estimate of error in the IPP, and (c) the remaining maximum maneuver distance.

Example 2 includes the controller of Example 1, wherein the roll angle calculation circuit is configured to: calculate a range error and a cross range error based on a difference between the target location and the IPP of the projectile calculated at the current time of flight; and determine the desired ground motion of the projectile based on the range error and the cross range error.

Example 3 includes the controller of Examples 1 or 2, wherein the estimate of error in the IPP comprises an estimate of range error in the IPP and an estimate of cross range error in the IPP, wherein the estimate of range error in the IPP is proportional, by a first scale factor, to a calculated range to the target, and the estimate of cross range error in the IPP is proportional, by a second scale factor, to the calculated range to the target.

Example 4 includes the controller of any of Examples 1-3, wherein the lift calculation circuit is configured to calculate the lift command as a product of a maximum lift deflection of the projectile and a scale factor, the scale factor set to the minimum of one and the square of the ratio of (1) the distance between the target location and the IPP of the projectile calculated at the current time of flight and (2) the estimate of error in the IPP.

Example 5 includes the controller of Example 4, wherein the scale factor is set to one if the distance between the target location and the IPP of the projectile calculated at the current time of flight is greater than the remaining maximum maneuver distance.

Example 6 includes the controller of any of Examples 1-5, wherein the lift command is set to zero if the ground motion of the projectile associated with the roll angle obtained from the steering map differs from the desired ground motion by more than a threshold value, the threshold value in the range of 10 to 20 degrees.

Example 7 includes the controller of any of Examples 1-6, wherein the steering map provides a maximum change in range of the projectile and a maximum change in cross range of the projectile at a given time of flight of the projectile and a given roll angle of the projectile.

Example 8 is a computer program product including one or more machine-readable mediums encoded with instructions that when executed by one or more processors cause a process to be carried out for guiding a projectile, the process comprising: generating a roll command to control roll canards of the projectile based on a roll angle, obtained from a steering map, that cause a change in range of the projectile and a change in cross range of the projectile that results in a ground motion of the projectile, at a current time of flight, that is closest to a desired ground motion, relative to other roll angle entries in the steering map; calculating a remaining maximum maneuver distance for the projectile, over a time period extending from the current time of flight to an ending time of flight, the calculation based on an integration of a series of maximum maneuvers, each of the maximum maneuvers obtained from the steering map, at a time interval within the time period; and generating a lift command to control lift canards of the projectile based on one or more of (a) a distance between a target location and an impact point prediction (IPP) of the projectile calculated at the current time of flight, (b) an estimate of error in the IPP, and (c) the remaining maximum maneuver distance.

Example 9 includes the computer program product of Example 8, wherein the process further comprises: calculating a range error and a cross range error based on a difference between the target location and the IPP of the projectile calculated at the current time of flight; and determining the desired ground motion of the projectile based on the range error and the cross range error.

Example 10 includes the computer program product of Examples 8 or 9, wherein the estimate of error in the IPP comprises an estimate of range error in the IPP and an estimate of cross range error in the IPP, wherein the estimate of range error in the IPP is proportional, by a first scale factor, to a calculated range to the target, and the estimate of cross range error in the IPP is proportional, by a second scale factor, to the calculated range to the target.

Example 11 includes the computer program product of any of Examples 8-10, wherein the process further comprises calculating the lift command as a product of a maximum lift deflection of the projectile and a scale factor, the scale factor set to the minimum of one and the square of the ratio of (1) the distance between the target location and the IPP of the projectile calculated at the current time of flight and (2) the estimate of error in the IPP.

Example 12 includes the computer program product of Example 11, wherein the scale factor is set to one if the distance between the target location and the IPP of the projectile calculated at the current time of flight is greater than the remaining maximum maneuver distance.

Example 13 includes the computer program product of any of Examples 8-12, wherein the lift command is set to zero if the ground motion of the projectile associated with the roll angle obtained from the steering map differs from the desired ground motion by more than a threshold value, the threshold value in the range of 10 to 20 degrees.

Example 14 includes the computer program product of any of Examples 8-13, wherein the steering map provides a maximum change in range of the projectile and a maximum change in cross range of the projectile at a given time of flight of the projectile and a given roll angle of the projectile.

Example 15 is a method for guiding a projectile, the method comprising: generating, by a processor based system, a roll command to control roll canards of the projectile based on a roll angle, obtained from a steering map, that cause a change in range of the projectile and a change in cross range of the projectile that results in a ground motion of the projectile, at a current time of flight, that is closest to a desired ground motion, relative to other roll angle entries in the steering map; calculating, by the processor based system, a remaining maximum maneuver distance for the projectile, over a time period extending from the current time of flight to an ending time of flight, the calculation based on an integration of a series of maximum maneuvers, each of the maximum maneuvers obtained from the steering map, at a time interval within the time period; and generating, by the processor based system, a lift command to control lift canards of the projectile based on one or more of (a) a distance between a target location and an impact point prediction (IPP) of the projectile calculated at the current time of flight, (b) an estimate of error in the IPP, and (c) the remaining maximum maneuver distance.

Example 16 includes the method of Example 15, further comprising: calculating a range error and a cross range error based on a difference between the target location and the IPP of the projectile calculated at the current time of flight; and determining the desired ground motion of the projectile based on the range error and the cross range error.

Example 17 includes the method of Examples 15 or 16, wherein the estimate of error in the IPP comprises an estimate of range error in the IPP and an estimate of cross range error in the IPP, wherein the estimate of range error in the IPP is proportional, by a first scale factor, to a calculated range to the target, and the estimate of cross range error in the IPP is proportional, by a second scale factor, to the calculated range to the target.

Example 18 includes the method of any of Examples 15-17, wherein the process further comprises calculating the lift command as a product of a maximum lift deflection of the projectile and a scale factor, the scale factor set to the minimum of one and the square of the ratio of (1) the distance between the target location and the IPP of the projectile calculated at the current time of flight and (2) the estimate of error in the IPP.

Example 19 includes the method of Example 18, wherein the scale factor is set to one if the distance between the target location and the IPP of the projectile calculated at the current time of flight is greater than the remaining maximum maneuver distance.

Example 20 includes the method of any of Examples 15-19, wherein the lift command is set to zero if the ground motion of the projectile associated with the roll angle obtained from the steering map differs from the desired ground motion by more than a threshold value, the threshold value in the range of 10 to 20 degrees.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be appreciated in light of this disclosure. The present disclosure should, therefore, be considered to encompass such combinations, variations, and modifications. It is intended that the scope of the present disclosure be limited not by this detailed description, but rather by the claims appended hereto. Future filed applications claiming priority to this application may claim the disclosed subject matter in a different manner and may generally include any set of one or more elements as variously disclosed or otherwise demonstrated herein.

What is claimed is:

1. A projectile guidance controller comprising:

a roll angle calculation circuit configured to generate a roll command to control roll canards of the projectile based on a roll angle, obtained from a steering map, that cause a change in range of the projectile and a change in cross range of the projectile that results in a ground motion of the projectile, at a current time of flight, that is closest to a desired ground motion, relative to other roll angle entries in the steering map;

a maneuver distance calculation circuit coupled to an output of the roll angle calculation circuit and configured to calculate a remaining maximum maneuver distance for the projectile, over a time period extending from the current time of flight to an ending time of flight, the calculation based on an integration of a series of maximum maneuvers, each of the maximum maneuvers obtained from the steering map, at a time interval within the time period; and a lift calculation circuit coupled to an output of the maneuver distance calculation circuit and configured to generate a lift command to control lift canards of the projectile based on one or more of (a) a distance between a target location and an impact point prediction (IPP) of the projectile calculated at the current time of flight, (b) an estimate of error in the IPP, and (c) the remaining maximum maneuver distance.

2. The projectile guidance controller of claim 1, wherein the roll angle calculation circuit is configured to:

calculate a range error and a cross range error based on a difference between the target location and the IPP of the projectile calculated at the current time of flight; and determine the desired ground motion of the projectile based on the range error and the cross range error.

3. The projectile guidance controller of claim 1, wherein the estimate of error in the IPP comprises an estimate of range error in the IPP and an estimate of cross range error in the IPP, wherein the estimate of range error in the IPP is proportional, by a first scale factor, to a calculated range to the target, and the estimate of cross range error in the IPP is proportional, by a second scale factor, to the calculated range to the target.

4. The projectile guidance controller of claim 1, wherein the lift calculation circuit is configured to calculate the lift command as a product of a maximum lift deflection of the projectile and a scale factor, the scale factor set to the minimum of one and the square of the ratio of (1) the distance between the target location and the IPP of the projectile calculated at the current time of flight and (2) the estimate of error in the IPP.

5. The projectile guidance controller of claim 4, wherein the scale factor is set to one if the distance between the target location and the IPP of the projectile calculated at the current time of flight is greater than the remaining maximum maneuver distance.

6. The projectile guidance controller of claim 1, wherein the lift command is set to zero if the ground motion of the projectile associated with the roll angle obtained from the steering map differs from the desired ground motion by more than a threshold value, the threshold value in the range of 10 to 20 degrees.

7. The projectile guidance controller of claim 1, wherein the steering map provides a maximum change in range of the projectile and a maximum change in cross range of the projectile at a given time of flight of the projectile and a given roll angle of the projectile.

8. A computer program product including one or more machine-readable mediums encoded with instructions that when executed by one or more processors cause a process to be carried out for guiding a projectile, the process comprising:

generating a roll command to control roll canards of the projectile based on a roll angle, obtained from a steering map, that cause a change in range of the projectile and a change in cross range of the projectile that results in a ground motion of the projectile, at a current time of flight, that is closest to a desired ground motion, relative to other roll angle entries in the steering map;

calculating a remaining maximum maneuver distance for the projectile, over a time period extending from the current time of flight to an ending time of flight, the calculation based on an integration of a series of maximum maneuvers, each of the maximum maneuvers obtained from the steering map, at a time interval within the time period; and generating a lift command to control lift canards of the projectile based on one or more of (a) a distance between a target location and an impact point prediction (IPP) of the projectile calculated at the current time of flight, (b) an estimate of error in the IPP, and (c) the remaining maximum maneuver distance.

9. The computer program product of claim 8, wherein the process further comprises:

calculating a range error and a cross range error based on a difference between the target location and the IPP of the projectile calculated at the current time of flight; and determining the desired ground motion of the projectile based on the range error and the cross range error.

10. The computer program product of claim 8, wherein the estimate of error in the IPP comprises an estimate of range error in the IPP and an estimate of cross range error in the IPP, wherein the estimate of range error in the IPP is proportional, by a first scale factor, to a calculated range to the target, and the estimate of cross range error in the IPP is proportional, by a second scale factor, to the calculated range to the target.

11. The computer program product of claim 8, wherein the process further comprises calculating the lift command as a product of a maximum lift deflection of the projectile and a scale factor, the scale factor set to the minimum of one and the square of the ratio of (1) the distance between the target location and the IPP of the projectile calculated at the current time of flight and (2) the estimate of error in the IPP.

12. The computer program product of claim 11, wherein the scale factor is set to one if the distance between the target location and the IPP of the projectile calculated at the current time of flight is greater than the remaining maximum maneuver distance.

13. The computer program product of claim 8, wherein the lift command is set to zero if the ground motion of the projectile associated with the roll angle obtained from the steering map differs from the desired ground motion by more than a threshold value, the threshold value in the range of 10 to 20 degrees.

14. The computer program product of claim 8, wherein the steering map provides a maximum change in range of the projectile and a maximum change in cross range of the projectile at a given time of flight of the projectile and a given roll angle of the projectile.

15. A method for guiding a projectile, the method comprising:

generating, by a processor based system, a roll command to control roll canards of the projectile based on a roll angle, obtained from a steering map, that cause a change in range of the projectile and a change in cross range of the projectile that results in a ground motion of the projectile, at a current time of flight, that is closest to a desired ground motion, relative to other roll angle entries in the steering map;

calculating, by the processor based system, a remaining maximum maneuver distance for the projectile, over a time period extending from the current time of flight to an ending time of flight, the calculation based on an integration of a series of maximum maneuvers, each of the maximum maneuvers obtained from the steering map, at a time interval within the time period; and generating, by the processor based system, a lift command to control lift canards of the projectile based on one or more of (a) a distance between a target location and an impact point prediction (IPP) of the projectile calculated at the current time of flight, (b) an estimate of error in the IPP, and (c) the remaining maximum maneuver distance.

16. The method of claim 15, further comprising:

calculating a range error and a cross range error based on a difference between the target location and the IPP of the projectile calculated at the current time of flight; and determining the desired ground motion of the projectile based on the range error and the cross range error.

17. The method of claim 15, wherein the estimate of error in the IPP comprises an estimate of range error in the IPP and an estimate of cross range error in the IPP, wherein the estimate of range error in the IPP is proportional, by a first scale factor, to a calculated range to the target, and the estimate of cross range error in the IPP is proportional, by a second scale factor, to the calculated range to the target.

18. The method of claim 15, wherein the process further comprises calculating the lift command as a product of a maximum lift deflection of the projectile and a scale factor, the scale factor set to the minimum of one and the square of the ratio of (1) the distance between the target location and the IPP of the projectile calculated at the current time of flight and (2) the estimate of error in the IPP.

19. The method of claim 18, wherein the scale factor is set to one if the distance between the target location and the IPP of the projectile calculated at the current time of flight is greater than the remaining maximum maneuver distance.

20. The method of claim 15, wherein the lift command is set to zero if the ground motion of the projectile associated with the roll angle obtained from the steering map differs from the desired ground motion by more than a threshold value, the threshold value in the range of 10 to 20 degrees.

* * * * *